US009680246B2

(12) United States Patent
Takahashi

(10) Patent No.: US 9,680,246 B2
(45) Date of Patent: Jun. 13, 2017

(54) METHOD FOR MANUFACTURING PLATED LAMINATE, AND PLATED LAMINATE

(71) Applicant: Oriental Electro Plating Corporation, Kobe-shi, Hyogo (JP)

(72) Inventor: Hiroyoshi Takahashi, Kobe (JP)

(73) Assignee: Oriental Electro Plating Corporation, Kobe-shi, Hyogo (JP)

( * ) Notice: Subject to any disclaimer, the term of this patent is extended or adjusted under 35 U.S.C. 154(b) by 0 days.

(21) Appl. No.: 15/027,778

(22) PCT Filed: Apr. 16, 2014

(86) PCT No.: PCT/JP2014/002168

§ 371 (c)(1),
(2) Date: Apr. 7, 2016

(87) PCT Pub. No.: WO2014/199547

PCT Pub. Date: Dec. 18, 2014

(65) Prior Publication Data

US 2016/0254608 A1 Sep. 1, 2016

(30) Foreign Application Priority Data

Jun. 10, 2013 (JP) ..... 2013-121772
Nov. 18, 2013 (JP) ..... 2013-238009
Mar. 14, 2014 (JP) ..... 2014-051783

(51) Int. Cl.

| | |
|---|---|
| ***H01R 13/03*** | (2006.01) |
| ***C25D 5/12*** | (2006.01) |
| ***C25D 3/12*** | (2006.01) |
| ***C25D 3/38*** | (2006.01) |

(Continued)

(52) U.S. Cl.
CPC ..... *H01R 13/03* (2013.01); *C25D 3/12* (2013.01); *C25D 3/38* (2013.01); *C25D 3/46* (2013.01);

(Continued)

(58) Field of Classification Search
CPC ..... C25D 5/34; H01R 13/03
See application file for complete search history.

(56) References Cited

U.S. PATENT DOCUMENTS 4,230,383 A * 10/1980 Burnstein ..... H01R 12/714 310/324
5,601,696 A * 2/1997 Asakawa ..... C25D 3/46 106/1.23

(Continued)

FOREIGN PATENT DOCUMENTS

EP 2 431 501 * 3/2012 ..... C25D 3/46
JP H0855521 A 2/1996

(Continued)

OTHER PUBLICATIONS

Int'l Search Report issued Jul. 22, 2014 in Int'l Application No. PCT/JP2014/002168.

*Primary Examiner* — James Harvey
(74) *Attorney, Agent, or Firm* — Panitch Schwarze Belisario & Nadel LLP

(57) ABSTRACT

A tin-plated/silver-plated laminate which has excellent abrasion resistance, electrical conductivity and slidability and a low frictional property is provided, which prevents the embrittlement of a plating layer contained therein. A method for producing the laminate involves forming a silver plating layer on a tin plating layer that is formed on the surface of a metallic base material by subjecting an arbitrary region in the surface of a tin plating layer to a nickel plating treatment to form a nickel plating layer; subjecting an arbitrary region in the surface of the nickel plating layer to a silver strike plating treatment; and subjecting at least a part of the surface region of the nickel plating layer, which has been subjected to the silver strike plating treatment, to a silver plating treatment.

3 Claims, 8 Drawing Sheets

(51) Int. Cl.

| | |
|---|---|
| ***C25D 3/46*** | (2006.01) |
| ***C25D 3/48*** | (2006.01) |
| ***C25D 3/50*** | (2006.01) |
| ***C25D 5/14*** | (2006.01) |
| ***C25D 5/34*** | (2006.01) |
| ***H01R 43/16*** | (2006.01) |
| *C25D 5/50* | (2006.01) |

(52) U.S. Cl.
CPC ..... *C25D 3/48* (2013.01); *C25D 3/50* (2013.01); *C25D 5/12* (2013.01); *C25D 5/14* (2013.01); *C25D 5/34* (2013.01); *H01R 43/16* (2013.01); *C25D 5/50* (2013.01)

(56) References Cited

U.S. PATENT DOCUMENTS 6,207,035 B1 * 3/2001 Adler ..... C23C 2/08 205/154
6,254,979 B1 * 7/2001 Drew ..... B32B 15/01 205/109
2007/0243452 A1 * 10/2007 Weidman ..... H01M 4/8817 429/483
2011/0168228 A1 * 7/2011 McGreevy ..... H02S 40/34 136/244
2015/0079422 A1 * 3/2015 Sunaga ..... C23C 28/023 428/673
2016/0064846 A1 * 3/2016 Tadokoro ..... H01R 13/03 439/886
2016/0254608 A1 * 9/2016 Takahashi ..... C25D 3/12

FOREIGN PATENT DOCUMENTS

| | | | |
|---|---|---|---|
| JP | 2001003194 | A | 1/2001 |
| JP | 2009076322 | A | 4/2009 |
| JP | 2011026677 | A | 2/2011 |
| JP | 2011231369 | A | 11/2011 |

* cited by examiner

METHOD FOR MANUFACTURING PLATED LAMINATE, AND PLATED LAMINATE

CROSS-REFERENCE TO RELATED APPLICATION

This application is a Section 371 of International Application No. PCT/JP2014/002168, filed Apr. 16, 2014, which was published in the Japanese language on Dec. 18, 2014, under International Publication No. WO 2014/199547 A1, and the disclosure of which is incorporated herein by reference.

TECHNICAL FIELD

The present invention relates to a method for manufacturing a plated laminate and a plating laminate obtained using the manufacturing method, and more specifically, a tin-plated/silver-plated laminates that have superior abrasion resistance, electrical conductivity, slidability and low frictional property, and, that are suitable for suppressing embrittlement of a plated layer, and a manufacturing method thereof.

BACKGROUND TECHNOLOGY

Silver plating has superior characteristics in low contact resistivity, heat resistance and the like, and is widely utilized for electric/electronic components, such as various contacts, terminals, connectors or switches (for example, see Patent Literature 1 (Japanese Patent Application Laid-Open No. 2001-3194)).

Recently, electric cars, plug-in hybrid cars and the like have become popular, and in association with this, battery chargers, such as battery chargers for household use or rapid battery chargers, also become popular. A terminal of a charging connector to connect a car and a battery charger has to endure connection and disconnection actions over several tens of thousands of times in addition to a use under high voltage and high electrical current.

Herein, tin-plated or reflow tin-plated materials on a copper substrate are often used for the terminals of electric and electronic components above, and if a surface of the material can be excellently silvered, it is believed that superior abrasion resistance and electrical conductivity can be added to a terminal.

However, it is extremely difficult to plate silver, which is noble metal, on tin, which is base metal, and displacement between tin and silver occurs due to a potential difference between tin and silver occurs (diffused from each other), and peel-off of silver plating or the like happens to occur. From those reasons, it is a current situation where a technology to laminate excellent silver plating on tin plating does not exist.

In this regard, for example, in Patent Literature 2 (Japanese Patent Application Laid-Open H8-176883), a manufacturing method for plate materials including steps to establish a Sn-plated layer at least on a portion of a base material surface made from copper or copper alloy, and to composite-plate one or more types out of Cu, In, Ag, Zn and Sb on the Sn plated layer is disclosed.

However, the manufacturing method described in Patent Literature 2 aims at manufacturing of the Sn alloy-plated material, and it is characterized by forming a Sn alloy-plated layer containing 80% to 99% of Sn (provided a total amount of Su, Zn and Sb in the plated layer is 10% or less) on at least a portion of the base material surface, by heating a composite plating obtained in the step above. The technique is to alloy tin and silver by heating, and poor adhesion between tin plating and silver plating is not a serious problem (in other words, this is not a technology to laminate excellent silver plating on tin plating).

In addition, in the case of directly making contact between the tin-plated layer and the silver-plated layer, the tin-plated layer and/the silver-plated layer shall be embrittled due to the formation of an intermetallic compound in association with diffusion and reaction between tin and silver (for example, $Ag_3Sn$).

PRIOR TECHNICAL LITERATURE

Patent Literature

Japanese Patent Application Laid-Open 2001-3194
Japanese Patent Application Laid-Open H8-176883

SUMMARY OF INVENTION

Problem to be Solved by the Invention

In reflection of such problems in the prior art, the objective of the present invention is to provide a tin-plated/silver-plated laminate that has superior abrasion resistance, electrical conductivity, slidability and low frictional property, and, that is suitable for suppressing embrittlement of the plated layer, and a manufacturing method thereof.

Means for Solving the Problem

The present inventor, as a result of keen study about a method for laminating silver plating on tin plating in order to accomplish the objective above, has discovered that it would be extremely effective to form a nickel-plated layer by plating nickel to tin plating and to plate silver strike to the nickel-plated layer as a preliminary treatment of silver plating, and accomplished the present invention.

In other words, the present invention provides a method for manufacturing a plated laminate where a silver-plated layer is formed on a tin-plated layer formed on a surface of a metal substrate, including:

a first step to apply nickel-plating processing in any region on the surface of the tin-plated layer and to form a nickel-plated layer;

a second step to apply silver strike plate processing in any region on the surface of the nickel-plated layer; and a third step to apply silver plate processing to at least a portion on the surface of the nickel plated layer after the silver strike processing has been applied.

In the method for manufacturing a plated laminate relating to the present invention, one or more types of strike plating to be selected from a group constituting of silver strike plating, gold strike plating, palladium strike plating, nickel strike plating and copper strike plating are applied as the pre-processing of the first step to any region on the surface of the tin-plated layer where the nickel-plated layer will be formed. The adhesion between the tin-plated layer and the silver-plated layer can be certainly improved by strike-plating to a region where the tin-plated layer and the nickel-plated layer are formed.

Here, a nickel-plated layer that is formed by the nickel plate processing in the first step is preferably a continuous film shape, and thickness of the nickel-plated layer is preferably 0.05 μm to 10 μm. Further, the thickness of the nickel-plated layer is more preferably 0.5 μm to 2 μm. If the thickness is less than 0.05 μm, the nickel-plated layer lacks a barrier effect, and if the thickness is 10 μm or greater, a crack is easily generated at the time of bending process. Furthermore, the nickel-plated layer may be a granular or insular discontinuous film shape within a scope not impairing the effects of the present invention. In the case of the latter, the granular or insular portions may be partially continued.

Further, a silver-plated layer that is formed by the silver strike plate processing in the second step may be a continuous film shape, or may be a granular or insular discontinuous film shape within a scope not impairing the effects of the present invention. In the case of the latter, the granular or insular portions may be partially continued. Furthermore, a silver-plated layer is formed on the silver strike-plated layer by the silver plate processing in the third step, and a single silver-plated layer is schematically obtained. The thickness of silver strike-plated layer is preferably 0.01 μm to 0.5 μm.

Further, in the method for manufacturing a plated laminate relating to the present invention, the thickness of the single silver-plated layer that can be obtained via the silver plate processing in the third step is preferably 0.1 μm to 50 μm. Furthermore, the thickness is a value combining the silver strike-plated layer and the silver-plated layer.

The single silver-plated layer that can be obtained via the silver plate processing in the third step basically has consistent thickness, but it can be partially thinner or thicker within a scope not impairing the effects of the present invention. Further, the Vickers hardness of the silver-plated layer is preferably 10 HV to 250 HV.

Furthermore, the tin-plated layer in the present invention is a concept containing a tin-plated layer as is after electrodeposition and a reflow tin-plated layer where a reflow process has been applied after the electrodeposition. Furthermore, the reflow tin-plated layer means a tin-plated layer where the electrodeposited tin-plated layer is heated and melted once, and then is chilled (hereafter, this is similarly referred).

Further, the present invention also provides a plated laminate precursor for manufacturing the plated laminate of the present invention above. The plated laminate precursor of the present invention is characterized by having a tin-plated layer formed on a surface of a metal substrate and a strike-plated layer formed on the tin-plated layer. The strike-plated layer should be one or more strike-plated layers to be selected from a group of silver strike plating, gold strike plating, palladium strike plating, nickel strike plating and copper strike plating.

Since one or more strike plated layers to be selected from a group constituted of silver strike plating, gold strike plating, palladium strike plating, nickel strike plating and copper strike plating are formed on the surface of a tin-plated layer in the plated laminate precursor of the present invention, a plated layer, such as a nickel-plated layer excelling in adhesion, can be easily formed on the strike-plated layer.

Therefore, the plated laminate precursor of the present invention may have a tin-plated layer formed on the surface of the metallic substrate and the strike-plated layer(s) formed on the tin-plated layer, further having the plated layer(s) formed on the strike-plated layer(s).

The present invention relates to a method for manufacturing the plated laminate precursor above, as well. In other words, the method for manufacturing a plated laminate precursor relating to the present invention is characterized by having a step to strike-plate any region (i.e., desired predetermined region) on the surface of the tin-plated layer formed on the surface of the metallic substrate. The adhesion between the tin-plated layer and the nickel-plated layer can be more certainly improved by application the strike-plating processing to the region where the tin-plated layer and the nickel-plated layer are formed.

This method for manufacturing a plated laminate precursor relating to the present invention is further equipped with a step to form a nickel-plated layer by applying the nickel-plating processing to the region.

Further, the present invention also provides a plated laminate that can be obtained using the method for manufacturing a plated laminate above, and the plated laminate has a tin-plated layer formed on a surface of a metal substrate, a nickel-plated layer formed on the tin-plated layer and a silver-plated layer formed on the nickel-plated layer; the silver-plated layer is metallurgically bonded to the nickel-plated layer, and the nickel-plated layer is metallurgically bonded to tin-plated layer.

The metallurgical bonding means that a tin-plated layer and a silver-plated layer are bonded not via structural joining, such as an anchor effect, or a heterojunction layer, such as an adhesive, but the metals are directly bonded. The metallurgical bonding is a concept naturally including bonding by crystallographic matching (epitaxy), and it is preferable that each plated layer has accomplished bonding by the crystallographic matching (epitaxy) with each other.

Further, the present invention also relates to a connecting terminal including the plated laminate of the present invention, and a male terminal and/or a female terminal is made from the plated laminate of the present invention in the connecting terminal.

In the connecting terminal of the present invention, it is preferable that the outermost surface of a joint requiring abrasion resistance is a tin-plated layer and the outermost surface of a contact requiring electrical conductivity is a silver-plated layer.

Effect of the Invention

According to the method for manufacturing a plated laminate relating to the present invention, a tin-plated/silver-plated laminate that has superior abrasion resistance, electrical conductivity, slidability and low frictional property, and, that is suitable for suppression of embrittlement of the plated layer, and a manufacturing method thereof can be provided. Further, the tin-plated/silver-plated laminate of the present invention can be suitably used as a material for a connecting terminal requiring superior abrasion-resistant characteristic and electrical conductivity, and a connecting terminal combines superior abrasion resistance and electrical conductivity, and fitting properties can be provided.

MODE FOR CARRYING OUT THE INVENTION

Hereafter, with reference to drawings, typical embodiments of the method for manufacturing a plated laminate, the plated laminate and the connecting terminal relating to the present invention, but the present invention is not limited to only these. Furthermore, in the description below, the same or equivalent portions may be marked with the same symbols, and any redundant explanations may be omitted. Further, since the drawings are for schematically explaining the present invention, displayed dimensions of each constituent element and their ratios may be different from actual ones.

<<Method for Manufacturing Plated Laminate>>

Figure 1:
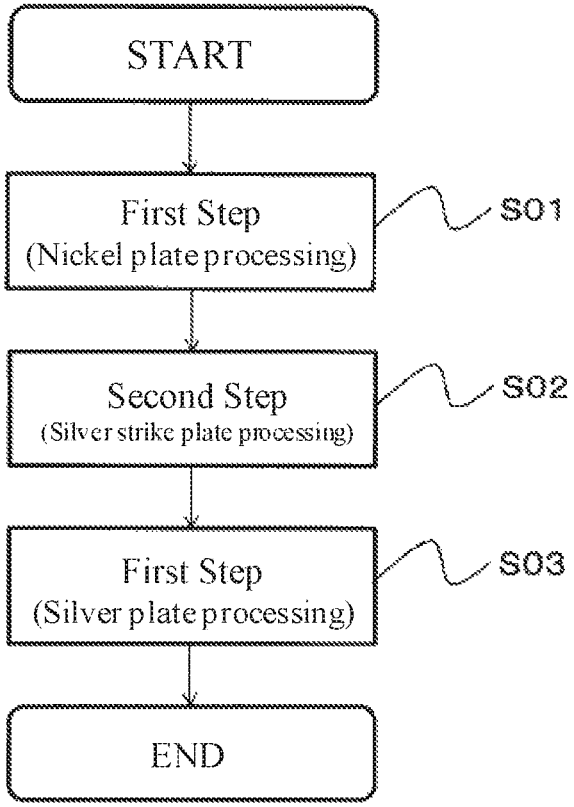
FIG. 1 is an operation flow chart of the method for manufacturing a plated laminate relating to the present invention.

FIG. 1 is an operation flow chart of the method for manufacturing a plated laminate relating to the present invention. The method for manufacturing a plated laminate relating to the present invention is a method for manufacturing a plated laminate by forming a silver-plated layer on a tin-plated layer, which has been formed on a surface of a metal substrate, and includes a first step (S01) to apply nickel-plating processing to any region on a surface of the tin-plated layer; a second step (S02) to apply silver strike-plating processing in any region on a surface of the nickel-plated layer; and a third step (S03) to silver-plate at least a portion on a surface of the nickel-plated layer after the silver strike plate processing.

Metal used for the metal substrate is not particularly limited as long as having the electrical conductivity, and for example, aluminum and aluminum alloy, iron and iron alloy, titanium and titanium alloy, stainless, copper and copper alloy and the like can be exemplified, and among them, it is preferable to use copper and copper alloy.

Washing treatment is applied to a metal substrate that has been tin-plated, and the plated laminate can be obtained via the first step (S01), the second step (S02) and the third step (S03). Hereafter, each processing is explained in detail.

(1) Tin-Plating Processing

For materials where a metal substrate has been tin-plated, commercially-available materials can be used. Further, for tin-plating, conventionally-known various tin-plating techniques can be used without impairing effects of the present invention.

Furthermore, a reflow to tin-plating is a process for suppressing growth of a whisker (needle metal crystal) that occurs during a passage of time, and a method to heat an electrodeposited tin-plated layer and to melt this layer once, and to rapidly cool it is used, in general. Stress (distortion) upon plating is removed by melting the tin-plated layer and formation of a diffusion layer with a metallic substrate enables reduction of the change over time.

As a tin-plating bath, there are an acidic bath, a neutral bath and an alkali bath, and any of these is usable. A sulfuric acid bath and an organic sulfonic acid bath as the acidic bath, a pyrophosphoric acid bath and a gluconic acid bath as the neutral bath, and a potassium stannate bath and a sodium stannate bath as the alkali bath are common.

For the reflow process, the tin-plated layer that is applied to a portion of or entire surface of the metal substrate should be heated and melted at a melting point or higher of tin. In order to mitigate internal stress of the tin-plated layer, preferable treatment temperature is 250° C. to 600° C., more preferably 300° C. to 500 and further preferably 350° C. to 450° C. Further, in order to improve plated appearance, the preferable processing time is for 30 seconds to 40 seconds, more preferably for 5 seconds to 30 seconds and further preferably for 5 seconds to 20 seconds. Other than those, the heating treatment is performed preferably under a reductive atmosphere or an inert atmosphere.

(2) Washing Treatment

The washing step is an optional step, and it is not shown in FIG. 1 but is a step to wash at least the surface of the tin-plated layer out of the metal substrate having the tin-plated layer. Herein, conventionally-known various washing treatment liquids or treatment conditions can be used within a scope not impairing the effects of the present invention.

For the washing treatment liquids, common immersional degreasing solutions or electrolytic degreasing solutions for non-ferrous metal(s) can be used, and in order to prevent corrosion of tin, which is an amphoteric metal, it is preferable to use the washing treatment solutions at pH exceeding 2 and less than 11, and it is preferable to avoid a use of a strong acidic bath at pH 2 or lower and a strong alkali bath at pH 11 or higher.

Specifically, [the tin-plated layer] is immersed into a bath where 0.1 to 10 g/L of surfactant is added to a slightly alkaline bath where 10 g to 50 g/L of sodium tertiary phosphate, sodium carbonate, sodium metasilicate, sodium orthosilicate or the like has been dissolved, at 20° C. to 70° C. of bath temperature for 10 seconds to 60 seconds. Further, cathode electrolytic degreasing can be performed at 2 to 5 $A/dm^2$ of cathode current density using an insoluble anode, such as stainless steel, a titanium platinum plate or iridium oxide, for the anode.

(3) Strike Plate Processing

A strike plate processing as a preliminary processing of nickel plate processing (first step (S01)) is an optional step, and it is not shown in FIG. 1, but adhesion of nickel plating can be certainly improved by applying one or more strike-plates to be selected from a group constituting of silver strike plating, gold strike plating, palladium strike plating, nickel strike plating and copper strike plating.

(A) Silver Strike Plating

As the silver strike plating bath, for example, a bath containing silver salt, such as silver cyanide or silver potassium cyanide, and conductive salt, such as potassium cyanide or potassium pyrophosphate, can be used.

For the silver strike plate processing, conventionally-known various silver plating techniques can be used within a range not impairing the effects of the present invention, and it is preferable to lower the concentration of silver salt in the plating bath and to increase the concentration of the conductive salt compared to normal silver plating.

The silver strike plating bath that can be suitably used for the silver strike plate processing is composed of silver salt, alkali cyanide salt and conductive salt, and a brightening agent may be added as needed. Suitable usages of each constitutional element are 1 to 10 g/L for the silver salt, 80 to 200 g/L for the alkali cyanide salt, 0 to 100 g/L for the conductive salt and up to 1,000 ppm for the brightening agent.

As the silver salt, for example, silver cyanide, silver iodide, silver oxide, silver sulfate, silver nitrate, silver chloride and the like are exemplified, and as the conductive salt, for example, potassium cyanide, sodium cyanide, potassium pyrophosphate, potassium iodide, sodium thiosulfate and the like are exemplified.

As the brightening agent, a metallic brightening agent and/or an organic brightening agent can be used. Further, as the metallic brightening agent, antimony (Sb), selenium (Se), tellurium (Te) and the like can be exemplified, and as the organic brightening agent, aromatic sulfonic acid compounds, such as benzenesulfonic acid, mercaptans and the like can be exemplified.

Silver strike plating conditions, such as bath temperature of the silver strike plating bath, anode materials or current density, can be appropriately set according to the plating bath to be used and requiring plating thickness and the like. For example, it is preferable to use insoluble anodes, such as stainless steel, a titanium platinum plate or iridium oxide, for the anode materials. Further, as the preferred plating conditions, bath temperature: 15° C. to 50° C., current density: 0.5 to 5 A/dm$^2$ and treatment time: 5 seconds to 60 seconds can be exemplified.

Furthermore, the silver strike plating may be applied to the entire surface of the tin-plated layer, and may be applied to only a region where nickel plating is desired to be formed in the first step (S01).

(B) Gold Strike Plating

As the gold strike plating, for example, one containing gold salt, conductive salt, a chelating agent and a crystal growing agent can be used. Further, for the gold strike plating bath, a brightening agent can be added.

For the gold salt, for example, gold cyanide, gold (I) potassium cyanide, gold (II) potassium cyanide, gold sodium sulfite, gold sodium thiosulfate or the like can be used. For the conductive salt, potassium citrate, potassium phosphate, potassium pyrophosphate, potassium thiosulfate or the like can be used. For the chelating agent, for example, ethylenediaminetetraacetic acid, methylenephosphonic acid or the like can be used. For the crystal growing agent, for example, cobalt, nickel, thallium, silver, palladium, tin, zinc, copper, bismuth, indium, arsenic, cadmium or the like can be used. Furthermore, as the pH adjuster, for example, polyphosphoric acid, citric acid, tartaric acid, potassium hydroxide, hydrochloric acid or the like may be added.

As the brightening agent, a metal brightening agent and/or an organic brightening agent can be used. Further, as the metal brightening agent, antimony (Sb), selenium (Se), tellurium (Te) and the like can be exemplified, and as the organic brightening agent, aromatic sulfonic acid compounds, such as benzenesulfonic acid, mercaptans and the like can be exemplified.

A preferred usage of each constitutional element in the gold strike plating bath that can be preferably used for the gold strike plating treatment is 1 to 10 g/L for the gold salt, 0 to 200 g/L for conductive salt, 0 to 30 g/L for the chelating agent, and 0 to 30 g/L for crystal growing agent.

The gold strike plating conditions, such as bath temperature of the gold strike plating bath, the anode materials or the current density, can be appropriately set according to the plating bath to be used, requiring plating thickness and the like. For example, for the anode materials, it is preferable to use a titanium platinum plate, insoluble anodes, such as iridium oxide, or the like. Further, as the preferred plating conditions, 20 to 40° C. for the bath temperature, 0.1 to 5.0 A/dm$^2$ for the current density, 1 second to 60 seconds for the treatment time and 0.5 to 7.0 for pH can be exemplified.

Furthermore, the gold strike plating may be applied to the entire surface of the metal substrate, and may be applied to only a region where nickel plating is desired to be applied in the first step (S01).

(C) Palladium Strike Plating

For the palladium strike plating bath, for example, a bath containing palladium salt and conductive salt can be used. Further, for the palladium strike plating bath, a brightening agent may be added.

For the palladium salt, for example, palladium chloride, palladium nitrate, palladium sulfate, dichloro tetraamminepalladium, diamino dichloropalladium or the like can be used. For the conductive salt, for example, potassium phosphate, potassium pyrophosphate, ammonium chloride, ammonium citrate, ammonium nitrate, sodium nitrate, potassium citrate or the like can be used. For the chelating agent, for example, ethylenediaminetetraacetic acid, methylenephosphonic acid or the like can be used.

As the brightening agent, saccharine sodium, sodium benzenesulfonate, benzene sulfonamide, butynediol, sodium benzaldehyde sulfonate and the like can be exemplified.

Preferred usages of each constituent element in a palladium strike plating bath that can be preferably used for palladium strike plate processing are 0.5 to 20 g/L for the palladium salt, 50 to 200 g/L for the conductive salt and 0 to 50 g/L for the brightening agent.

Palladium strike plating conditions, such as bath temperature of a palladium strike plating bath, anode materials or current density, can be appropriately set according to the plating bath to be used, required plating thickness and the like. For example, for the anode materials, it is preferable to use a titanium platinum plate, insoluble anodes, such as iridium oxide, or the like. Further, as the preferred plating conditions, 20° C. to 50° C. for the bath temperature, 0.1 to 5.0 a/dm$^2$ for the current density, and 1 second to 60 seconds for the treatment time can be exemplified.

Furthermore, the palladium strike plating may be applied to the entire surface of a metal substrate, and may be applied to only a region where nickel plating is desired to be formed in the first step (S01).

(D) Nickel Strike Plating

As a nickel strike plating bath, for example, a bath containing nickel salt, an anodic dissolution promoter and a pH buffering agent can be used. Further, for the nickel strike plating bath, an additive may be added.

For the nickel salt, for example, nickel sulfate, nickel sulfamate, nickel chloride or the like can be used. For the anodic dissolution promoter, for example, nickel chloride, hydrochloric acid or the like can be used. For the pH buffering agent, for example, boric acid, nickel acetate, citric acid or the like can be used. For the additive, for example, primary brightening agents (such as saccharin, benzene, (di- or tri-) naphthalene, sodium sulfonate, sulfonamide or sulfinic acid), secondary brightening agents (organic compounds: such as butynediol, coumarin or allyl aldehyde sulfonic, metallic salts: such as cobalt, lead or zinc), pit prevention agents (such as sodium lauryl sulfate) or the like can be used.

Preferred usages of each constituent element in the nickel strike plating bath that can be preferably used for the nickel strike plate processing are 100 to 300 g/L for nickel salt, 0 to 300 g/L for the anodic dissolution promoter, 0 to 50 g/L for the pH buffering agent, and 0 to 20 g/L for the additive.

The nickel strike plating conditions, such as bath temperature of the nickel strike plating bath, the anode materials or the current density, can be appropriately set according to the plating bath to be used, required plating thickness and the like. For example, for the anode materials, it is preferable to use soluble anodes, such as depolarized nickel or sulphur nickel, or the like. Further, as the preferred plating conditions, 20 to 30° C. for the bath temperature, 1.0 to 5.0 A/dm$^2$ for the current density, 1 second to 30 seconds for the processing time and 0.5 to 4.5 for pH can be exemplified.

Furthermore, the nickel strike plating may be applied to the entire surface of the metal substrate, or may be applied to only a region where nickel plating is desired to be formed in the first step (S01).

(E) Copper Strike Plating

As a copper strike plating bath, for example, a copper cyanide bath can be used. The copper cyanide bath is made from copper salt, alkali cyanide salt and conductive salt, and an additive(s) may be added.

For the copper salt, for example, copper cyanide or the like can be used. For the alkali cyanide salt, for example, potassium cyanide, sodium cyanide or the like can be used. For the conductive salt, for example, potassium carbonate, sodium carbonate or the like can be used. For the additive, for example, Rochelle salt, potassium selenite, sodium selenite, potassium thiocyanate, lead acetate, lead tartrate or the like can be used.

Preferred usages of each constituent element in a cyanogen-series bath that can be preferably used for the copper strike plate processing are 10 to 80 g/L for the copper salt, 20 to 50 g/L for alkali acid cyanide, 10 to 50 g/L for the conductive salt, and 0 to 60 g/L for the additive.

The copper plating conditions, such as bath temperature of the copper strike plating bath, the anode materials or the current density, can be appropriately set according to the plating bath to be used, required plating thickness and the like. For example, for the anode materials, it is preferable to use soluble anodes, such as electrolyte copper, and/or insoluble anodes, such as stainless steel, a titanium platinum plate or iridium oxide, and the like. Further, preferred plating conditions, 25° C. to 70° C. for the bath temperature, 0.1 to 6.0 A/dm$^2$ for the current density and 5 seconds to 60 seconds for the processing time can be exemplified.

Furthermore, the copper strike plating may be applied to the entire surface of the metal substrate, or may be applied to only a region where nickel plating is desired to be formed in the first step (S01).

For the various strike plates, only one type may be applied, and a plurality of strike plates may be laminated. Further, when the cohesion state of the nickel plating becomes excellent even without the strike plate processing due to the surface condition of the metal substrate, the strike plate processing can be omitted.

(4) Nickel Plate Processing (First Step (S01))

The nickel plate processing is processing to be applied for the purpose of forming a nickel-plated layer that functions as a barrier layer to prevent diffusion and reaction between tin and silver, between the tin-plated layer and the silver-plated layer. Because a nickel-plated layer exists between the tin-plated layer and the silver-plated layer, embrittlement of the tin-plated layer and/or the silver-plated layer by forming an intermetallic compound (for example, $Ag_3Sn$) in association with the diffusion and reaction between and tin and silver can be suppressed.

As the nickel plating bath, for example, Watts bath or a sulfamate bath can be used, but it is preferable to use the sulfamate bath where the stress in electrodeposits is low. Furthermore, it is preferable to avoid a strongly-acid wood strike bath. For the nickel plate processing, conventionally-known various nickel plating techniques can be used within the range not impairing the effects of the present invention. For example, for the nickel plating bath, a bath where small amounts of a brightening agent, a leveling agent, a pit prevention agent and the like are added to a liquid made from nickel salt, such as nickel sulfate, nickel sulfamate or nickel chloride, an anode dissolving agent, such as nickel chloride, and a pH buffering agent, such as boric acid, acetic acid or citric acid, can be used. Preferred usages of each constituent element are 100 to 600 g/L for the nickel salt, 0 to 50 g/L for the anode dissolving agent, 20 to 50 g/L for the pH buffering agent and up to 5,000 rpm for the additives.

Furthermore, as described above, the nickel plated layer that is formed by the nickel plate processing in the first step is preferably a continuous film shape, and the thickness of the nickel plated layer is preferably 0.05 μm to 10 μm. If this is less than 0.05 μm, [the nickel plated layer]lacks a barrier effect, and if it is 10 μm or greater, a crack is easily generated at the time of bending processing. Furthermore, the nickel-plated layer may be a granular or insular discontinuous film shape within the scope not impairing the effects of the present invention. In the case of the latter, the granular and insular portions may be partially continued.

(5) Silver Strike Plate Processing (Second Step (S02))

The silver strike plate processing is processing to be applied in order to improve adhesion between the nickel-plated layer and the silver-plated layer formed in the first step (S01). As the silver strike plating bath, for example, a bath containing silver salt, such as silver cyanide or silver potassium cyanide, and conductive salt, such as potassium cyanide or potassium pyrophosphate, can be used.

Conventionally-known various silver plating techniques can be used for the silver strike plate processing within a scope not impairing the effects of the present invention, and it is preferable to lower the concentration of silver salt and to increase the concentration of the conductive salt in the plating bath, compared to regular silver plating.

The silver strike plating bath that can be preferably used for the silver strike plate processing is made from silver salt, alkali cyanide salt and conductive salt, and a brightening agent may be added as needed. Preferred usages of each constituent element are 1 to 10 g/L for the silver salt, 80 to 200 g/L for the alkali cyanide salt, 0 to 100 g/L for the conductive salt and up to 1,000 ppm for the brightening agent.

As the silver salt, for example, silver cyanide, silver iodide, silver oxide, silver sulfate, silver nitrate, silver chloride and the like are exemplified, and as the conductive salt, for example, potassium cyanide, sodium cyanide, potassium pyrophosphate, potassium iodide, sodium thiosulfate and the like are exemplified.

As the brightening agent, a metal brightening agent and/or an organic brightening agent can be used. Further, as the metal brightening agent, antimony (Sb), selenium (Se), tellurium (Te) and the like can be exemplified, and as the organic brightening agent, aromatic sulfonic acid compounds, such as benzenesulfonic acid; mercaptans and the like can be exemplified.

The silver strike plating conditions, such as bath temperature of the silver strike plating bath, anode materials or current density, can be appropriately set according to the plating bath to be used, the required plating thickness and the like. For example, for the anode materials, it is preferable to use insoluble anodes, such as stainless steel, a titanium platinum plate or iridium oxide. Further, as the preferred to plating conditions, 15° C. to 50° C. for the bath temperature, 0.5 to 5 A/dm$^2$ for the current density and 5 seconds to 60 seconds for the processing time can be exemplified.

Furthermore, the silver strike plating may be applied to the entire surface of the nickel-plated layer, and may be applied to only a region where the silver plating is desired to be formed in the third step (S03)).

(6) Silver Plate Processing (Third Step (S03))

The silver plate processing is processing for forming a thicker single silver-plated layer from a schematic point of view, at least in a portion out of the silver strike-plated region in the second step (S02).

Conventionally-known various silver plating techniques can be used for the silver plate processing within a scope not impairing the present invention, and it is preferable to increase the concentration of silver salt in the plating bath and to lower the concentration of the conductive salt compared to the normal silver strike plating.

The silver plating bath that can be preferably used for the silver plate processing is made from silver salt, alkali cyanide salt and conductive salt, and a brightening agent may be added as needed. Preferable usages of each constituent element are 30 to 150 g/L for the silver salt, 15 to 160 g/L for the alkali cyanide salt, 500 to 200 g/L for the conductive salt and up to 100 ppm for the brightening agent.

As the silver salt, for example, silver cyanide, silver iodide, silver oxide, silver sulfate, silver nitrate, silver chloride and the like are exemplified, and as the conductive salt, for example, potassium cyanide, sodium cyanide, potassium pyrophosphate, potassium iodide, sodium thiosulfate and the like are exemplified.

As the brightening agent, a metal brightening agent and/or an organic brightening agent can be used. Further, as the metal brightening agent, antimony (Sb), selenium (Se), tellurium (Te) and the like can be exemplified, and as the organic brightening agent, aromatic sulfonic acid compounds and mercaptans can be exemplified.

Plating conditions, such as bath temperature of the plating bath, anode materials or current density, can be appropriately set according to the plating bath to be used, required plating thickness and the like. For example, it is preferable to use soluble anodes, and insoluble anodes, such as stainless steel, a titanium platinum plate or iridium oxide, for the anode materials. Further, as the preferred plating conditions, 20° C. to 60° C. for the bath temperature, 0.5 to 15 A/dm$^2$ for the current density and 0.5 seconds to 10,000 seconds for the processing time can be exemplified.

Furthermore, the silver plating may be applied to the entire surfaces of the metal substrate, the tin-plated layer and the nickel-plated layer, and may be applied to only the region where the silver strike plating has been formed in the second step (S02).

<<Plated Laminate Precursor>>

The plated laminate precursor of the present invention has a tin-plated layer formed on the surface of the metal substrate and one or more strike-plated layers to be selected from a group of silver strike plating, gold strike plating, palladium strike plating, nickel strike plating and copper strike plating formed on the tin-plated layer.

In the plated laminate precursor of the present invention, since one or more strike plated layers to be selected from a group of silver strike plating, gold strike plating, palladium strike plating, nickel strike plating and copper strike plating are formed on the surface of the tin-plated layer, a nickel-plated layer excelling in adhesion can be easily formed on the strike-plated layer, and it can be preferably used for manufacturing a plated laminate of the present invention.

<<Plated Laminate>>

(1) First Embodiment

Figure 2:
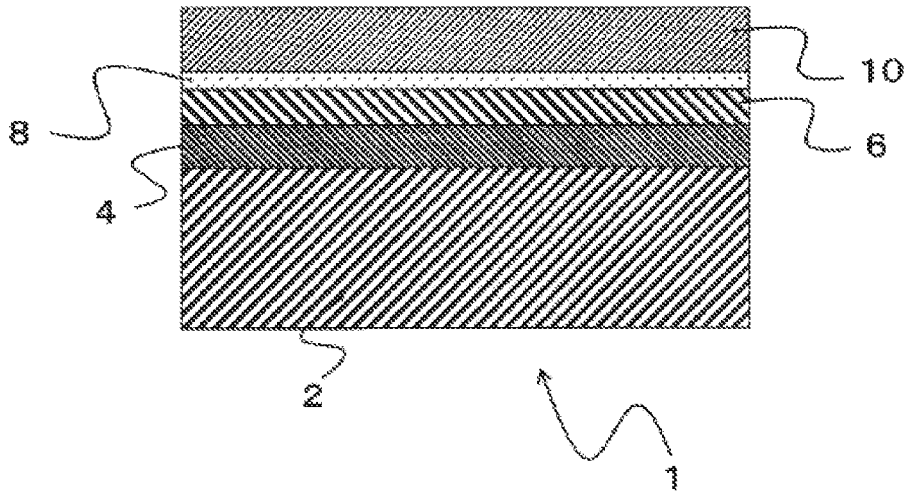
FIG. 2 is a schematic cross-sectional view of the First Embodiment of the silvered laminate of the present invention.

FIG. 2 is a schematic cross-sectional view of the First Embodiment of the plated laminate of the present invention. In a plated laminate 1, a tin-plated layer 4 is formed on the metal substrate 2, and a nickel-plated layer 6 is formed over the entire surface of the tin-plated layer 4. In addition, a silver strike-plated layer 8 is formed over the entire surface of the nickel-plated layer 6, and a silver-plated layer 10 is formed over the entire surface of the silver strike-plated layer 8. Furthermore, a silver strike-plated layer as similar to the silver strike-plated layer 8 is formed between the tin-plated layer 4 and the nickel-plated layer 6, as needed (not shown).

A metal of the metal substrate 2 is not particularly limited as long as having electrical conductivity, and for example, aluminum and aluminum alloy, iron and iron alloy, titanium and titanium alloy, stainless, copper and copper alloy and the like can be exemplified, and among them, it is preferable to use copper and copper alloy because they excel in electrical conductivity, thermal conductivity and ductility.

For the tin-plated layer 4, there are a tin-plated layer as is after electrodeposition and another tin-plated layer where reflow process is applied after electrodeposition, and a diffusion layer is formed in the vicinity of an interface between the metal substrate 2 and the tin-plated layer 4 if the reflow process is applied.

The nickel-plated layer 6 preferably has a continuous film shape, and thickness of the nickel-plated layer 6 is preferably 0.05 μm to 10 μm. Further, a more preferred thickness of the nickel-plated layer 6 is 0.5 μm to 2 μm. Furthermore, the nickel-plated layer 6 may have granular or insular discontinuous film shape within a scope not impairing the effects of the present invention. In the case of latter, the granular and insular portions can be partially continued.

Further, the silver strike-plated layer 8 may have a continuous film shape or granular or insular discontinuous film shape within a scope not impairing the effect of the present invention. In the case of latter, the granular or insular portions may be partially continued. Furthermore, there is also a case where it is difficult to identify the silver strike-plated layer 8 depending upon the silver strike plating conditions. The thickness of the silver strike-plated layer 8 is preferably 0.01 μm to 0.5 μm.

A silver-plated layer 10 is formed on the surface of the silver strike-plated layer 8. The thickness of the silver-plated layer 10 is preferably 0.1 μm to 50 μm, and Vickers hardness is preferably 10 HV to 250 HV. If the thickness is less than 0.1 μm, abrasion resistance of the silver-plated layer 10 cannot be utilized, and if it is thicker than 50 μm, because a usage of silver is increased, it is not economical.

(2) Second Embodiment

Figure 3:
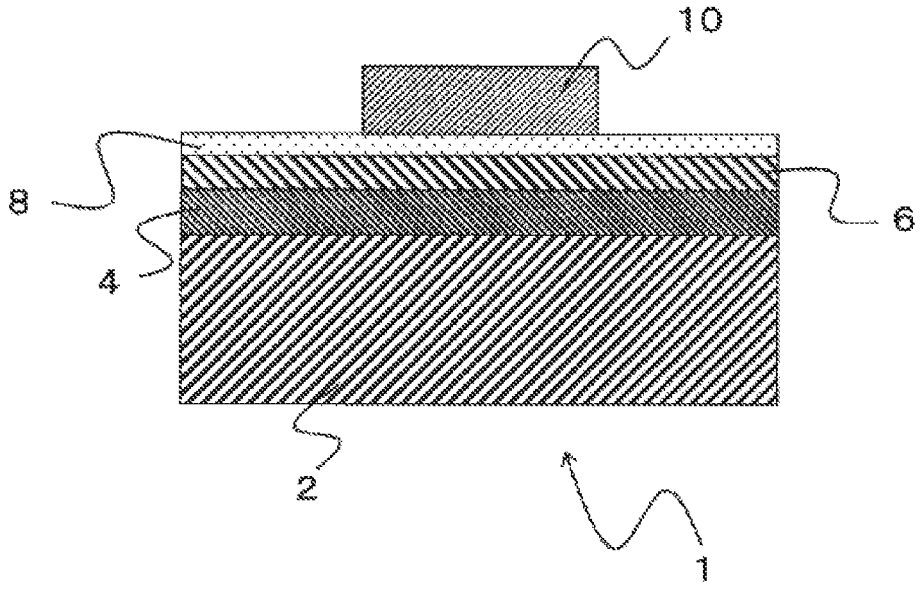
FIG. 3 is a schematic cross-sectional view of the Second Embodiment of the silvered laminate of the present invention.

FIG. 3 is a schematic cross-sectional view of the Second Embodiment of the plated laminate of the present invention. In the plated laminate 1, the tin-plated layer 4 is formed on the surface of the metal substrate 2, and the nickel-plated layer 6 is formed on the entire surface of the tin-plated layer 4. In addition, the silver strike-plated layer 8 is formed on the entire surface of the nickel plated layer 6, and the silver-plated layer 10 is formed on a portion of the surface of the silver strike-plated layer 8. Furthermore, except for the formation of the silver-plated layer 10 on a portion of the silver strike-plated layer 8, it is similar to the First Embodiment.

(3) Third Embodiment

Figure 4:
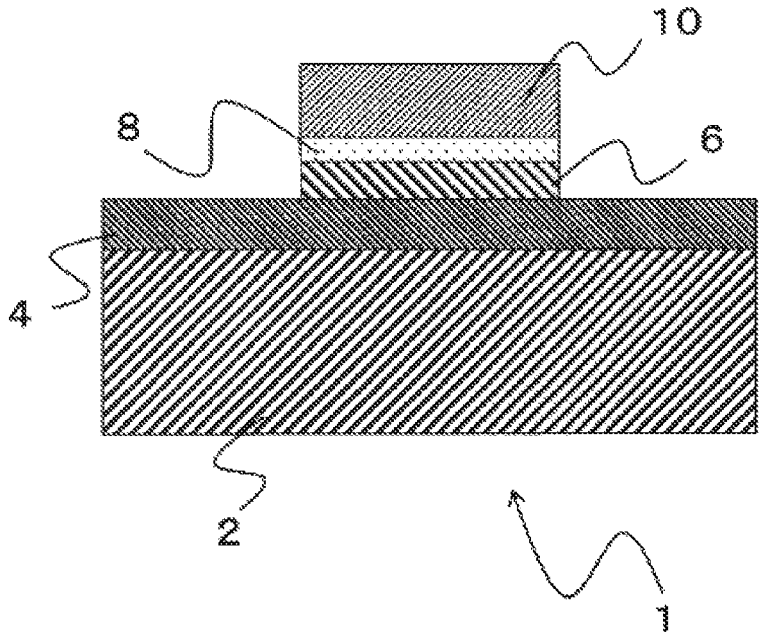
FIG. 4 is a schematic cross-sectional view of the Third Embodiment of the silvered laminate of the present invention.

FIG. 4 is a schematic cross-sectional view of the Third Embodiment of the plated laminate of the present invention.

In the plated laminate 1, the tin-plated layer 4 is formed on the surface of the metal substrate 2, and the nickel plated layer 6 is formed on a portion of the surface of the tin-plated layer 4. In addition, the silver strike-plated layer 8 is formed over the entire surface of the nickel plated layer 6, and the silver-plated layer 10 is formed over the entire surface of the silver strike-plated layer 8. Furthermore, except for the formation of the nickel-plated layer 6 on a portion of the surface of the tin-plated layer 4, the formation of the silver strike-plated layer 8 over the entire surface of the nickel-plated layer 6 and the formation of the silver-plated layer 10 over the entire surface of the silver strike-plated layer 8, it is similar to the First Embodiment.

(4) Fourth Embodiment

Figure 5:
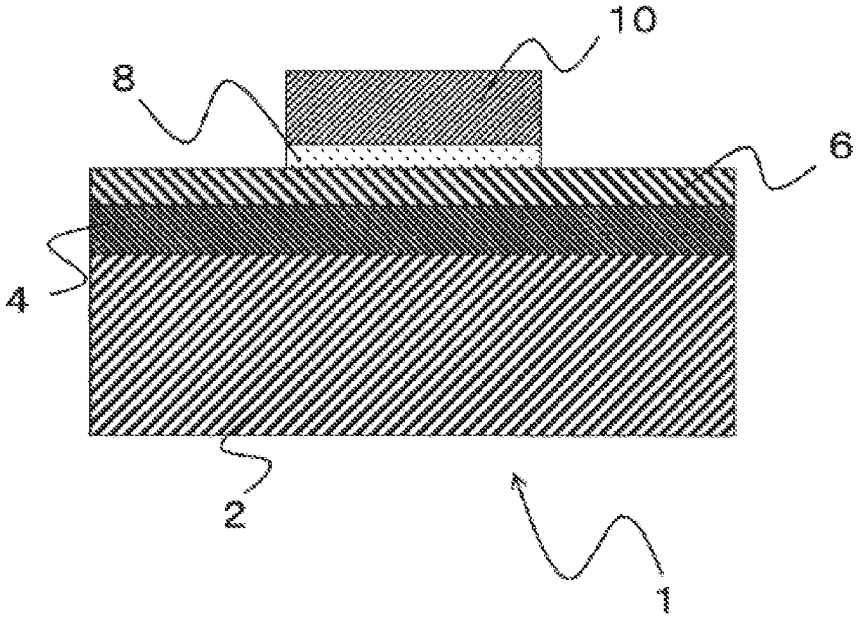
FIG. 5 is a schematic cross-sectional view of the Fourth Embodiment of the silvered laminate of the present invention.

FIG. 5 is a schematic cross-sectional view of the Fourth Embodiment of the plated laminate of the present invention. In the plated laminate 1, the tin-plated layer 4 is formed on the surface of the metal substrate 2, and the nickel-plated layer 6 is formed on the entire surface of the tin-plated layer 4. In addition, the silver strike-plated layer 8 is formed on a portion of the surface of the nickel plated layer 6, and the silver-plated layer 10 is formed over the entire surface of the silver strike-plated layer 8. Furthermore, except for the formation of the nickel-plated layer 6 over the entire surface of the tin-plated layer 4, the formation of the silver strike-plated layer 8 on a portion of the surface of the nickel-plated layer 6 and the formation of the silver-plated layer 10 over the entire surface of the silver strike-plated layer 8, it is similar to the First Embodiment. Further, in the First Embodiment to the Fourth Embodiment, although the tin-plated layer 4 is formed on the entire surface of the metal substrate 2, the tin-plated layer may be formed on a portion of the metal substrate 2.

<<Connecting Terminal>>

The plated laminate of the present invention can be preferably used for various connecting terminals. Specifically, an inexpensive high-performance connecting terminal can be manufactured by placing the tin-plated layer 4 on the outermost surface of a joint requiring abrasion resistance, and placing the silver-plated layer 10 on the outermost surface of a contact requiring electrical conductivity. The joint herein is a part that will be connected to other member(s) by interposing the other member(s) by inflection, swaging or the like.

Figure 6:
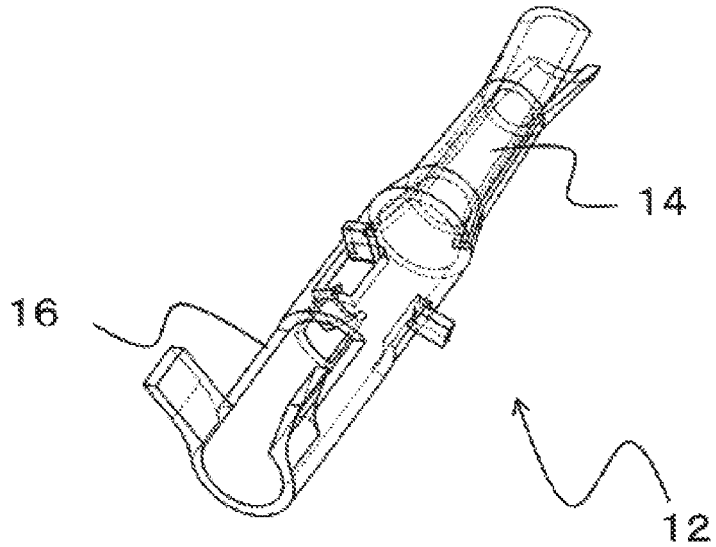
FIG. 6 is a schematic view showing one example of the connecting terminal of the present invention.

FIG. 6 is a (perspective) schematic drawing showing one example of the connecting terminal of the present invention. A connecting terminal shown in FIG. 6 is a high-voltage terminal, and the outermost surface of the contact part 14 requiring electrical conductivity in the connecting terminal 12 is the silver-plated layer 10, and the outermost surface is the tin-plated layer 4 at a connection part 16 with a harness requiring abrasion resistance.

Conventionally, reflow tin-plating excelling in bearing properties and workability has been often used for the connection terminal, and problems, such as poor abrasion resistance or high electric resistance, existed. In the meantime, superior abrasion resistance, low electric resistance and excellent heat resistance in the silver-plated layer 10 can be utilized by placing the outermost surface with the silver-plated layer 10.

In the plated laminate 1 of the present invention, since the nickel-plated layer 6 exists between the tin-plated layer 4 and the silver strike-plated layer 8 or the silver-plated layer 10, the nickel-plated layer 6 functions as a barrier layer to prevent diffusion and reflection of tin and silver between the tin-plated layer 4 and the silver strike-plated layer 8 or the silver-plated layer 10. In other words, because the nickel plated layer 6 exists between the tin-plated layer 4 and the silver strike-plated layer 8 or the silver-plated layer 10, the embrittlement of the tin-plated layer and/or the silver-plated layer by formation of an intermetallic compound (for example, $Ag_3Sn$) in association with the diffusion and reaction with tin and silver can be suppressed.

Further, in the plated laminate 1 of the present invention, since the tin-plated layer 4 and the nickel-plated layer 6 exist between the silver-plated layer 10 and the metal substrate 2, and, in addition, a diffusion layer and/or a reflective layer exists if the tin-plated layer 4 is a reflow tin-plated layer, the diffusion (or substitution) of metal (for example, copper) from the metal substrate 2 (for example, copper or copper alloy) to the silver-plated layer 10 that is attributable to the metal substrate 2 can be suppressed, and aging variation of the plated laminate 1 can be suppressed.

In addition, a significant accident, such as ignition or electrification, caused by fragments of the tin-plated layer 4 scattered due to abrasion by sliding, can be prevented by placing the silver-plated layer 10 to the outermost surface in the region where abrasion by sliding is obvious.

Thus, the typical embodiments of the present invention were explained, but the present invention is not limited to only these, but can be variously designed, and these design changes are all included in the technical scope of the present invention.

EXAMPLE

Example 1

In a commercially-available tin-plated material (a copper alloy material with 0.6 mm of thickness was tin-plated and reflow was applied), a nickel-plated layer with 0.05 μm [of thickness] and a silver-plated layer with 1 μm [of thickness] were formed with the steps below. A surface of the tin-plated layer was washed by immersing the tin-plated material into a washing treatment liquid containing 40 g/L of MAX-CLEEN® NG-30 manufactured by KIZAI Corporation for 60 seconds.

Next, nickel plate processing was applied using a nickel sulfide plate as an anode material and the tin-plated material after washing treatment as a cathode material in a nickel plating bath containing 300 g/L of nickel sulfamate, 5 g/L of nickel chloride hexahydrate, 10 g/L of boric acid and 0.2 g/L of sodium lauryl sulfate, under conditions of 50° C. for the bath temperature and 2 $A/dm^2$ for the current density, for 10 seconds (first step).

Next, silver strike plate processing was applied using a titanium platinum plate as an anode material and the tin-plated material after nickel plate processing in a silver strike plating bath containing 3 g/L of silver cyanide, 150 g/L of potassium cyanide and 15 g/L of potassium carbonate, under conditions of room temperature for the bath temperature and 2 $A/dm^2$ for the current density, for 10 seconds (second step).

Then, processing was applied using a titanium platinum plate as an anode material and the tin-plated material after the silver strike plate processing as a cathode material in a silver plating bath containing 40 g/L of silver cyanide, 30 g/L of potassium cyanide and 30 g/L potassium carbonate, under conditions of 30° C. for the and 4 $A/dm_2$ for the current density, for 26 seconds, and a single silver-plated layer with 1 μm [of thickness] was formed (third step).

[Evaluation]

(1) Adhesion Evaluation

Adhesion about the plated laminate produced as mentioned above was evaluated. A cellophane tape (#405 manufactured by NICHIBAN Co., Ltd.) was pressed to the silver-plated layer with finger pressure, and after the cellophane tape was peeled off, if peeling or swelling of the silver-plated layer did not occur, it was evaluated as ○, and if peeling or swelling occurred, it was evaluated as x, and obtained results are shown in Table 1.

(2) Confirmation of Intermetallic Compound ($Ag_3Sn$) Phase

Whether or not an intermetallic compound ($Ag_3Sn$) phase was formed in the produced plated laminated was checked. Specifically, whether or not there was a diffraction peak(s) derived from the intermetallic compound ($Ag_3Sn$) phase was checked according to results of X-ray diffraction to the plated laminates left at room temperature for 50 hours. A device used was Ultima IV (detector D/teXUltra, CuKα line used), and measurement was conducted under conditions of 40 kV-40 mA, 0.1° of step angle, 20° to 100° of a scan angle range. If a diffraction peak derived from the intermetallic compound ($Ag_3Sn$) phase was confirmed, it was evaluated as x, and if any diffraction peak was not confirmed, it was evaluated as ○, and the obtained results are shown in Table 1.

Example 2

Except for the formation of a nickel-plated layer with 0.1 μm of thickness by setting a time for nickel plate processing for 20 seconds, a plated laminate was produced as similar to Example 1 and various evaluations were conducted. Obtained results are shown in Table 1.

Example 3

Except for the formation of a silver-plated layer with 5 μm of thickness by setting a time for silver plate processing for 130 seconds, a plated laminate was produced as similar to Example 2 and various evaluations were conducted. Obtained results are shown in Table 1.

Example 4

Except for the formation of a silver-plated layer with 10 μm of thickness by setting a time for silver plate processing for 260 seconds, a plated laminate was produced as similar to Example 2 and various evaluations were conducted. Obtained results are shown in Table 1.

Example 5

Except for the formation of a nickel-plated layer with 10 μm of thickness by setting a time for nickel plate processing for 2,000 seconds, a plated laminate was produced as similar to Example 1 and various evaluations were conducted. Obtained results are shown in Table 1.

Example 6

A surface of the tin-plated layer was washed by immersing a commercially-available tin-plated material (a copper alloy material with 0.6 mm of thickness was tin-plated and reflow process was applied) into a washing treatment liquid at 50° C. containing 40 g/L of MAXCLEEN® NG-30 manufactured by KIZAI Corporation for 60 seconds.

Next, silver strike plate processing was applied using a titanium platinum material as an anode material and a tin-plated material after peeling processing as a cathode material in a silver strike plating bath containing 3 g/L of silver cyanide, 150 g/L of potassium cyanide and 15 g/L of potassium carbonate, under conditions of room temperature for the bath temperature and 2 A/dm$^2$ for the current density, for 10 seconds.

Next, nickel plate processing was applied using a nickel sulfide plate as an anode material and the tin-plated material after silver strike plate processing as a cathode material in a nickel plating bath containing 300 g/L of nickel sulfamate, 5 g/L of nickel chloride hexahydrate, 10 g/L of boric acid and 0.2 g/L of sodium lauryl sulfate, under conditions of 50° C. for the bath temperature and 2 A/dm$^2$ for the current density, for 200 seconds, and a nickel-plated layer with 1 μm [of thickness] was formed.

Then, silver strike plate processing was applied using a titanium platinum plate as an anode material and the tin-plated material after the nickel-plating processing as a cathode material in a silver strike plating bath containing 3 g/L of silver cyanide, 150 g/L of potassium cyanide and 15 g/L of potassium carbonate, under conditions of room temperature for the bath temperature and 2 A/dm$^2$ for the current density, for 10 seconds.

Next, processing was applied using a titanium platinum plate as an anode material and the tin-plated material after the silver strike plate processing as a cathode material in a silver plating bath containing 40 g/L of silver cyanide, 30 g/L of potassium cyanide and 30 g/L of potassium carbonate, under conditions of 30° C. for the bath temperature and 4 A/dm$^2$ for the current density, for 130 seconds, and a single silver-plated layer with 5 μm [of thickness] was formed.

[Evaluation]

(1) Adhesion Evaluation

After cutting [the obtained samples] to be grid at 1 mm of cut intervals (cross cut test), respectively, a cellophane tape (#405 manufactured by NICHIBAN Co., Ltd.) was pressed to the silver-plated layer with finger pressure, and after the cellophane tape was peeled off, if peeling or swelling of the silver-plated layer did not occur, it was evaluated as ○, and if peeling or swelling occurred, it was evaluated as x, and obtained results are shown in Table 2.

(2) Cross-Section Observation

Figure 7:
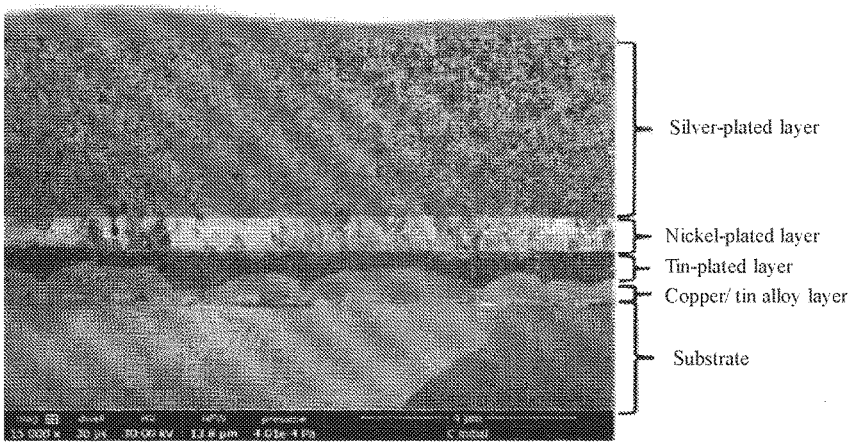
FIG. 7 is a photograph of cross-sectional observation of a specimen in an example of the present invention.

Cross-sections of samples were observed using focused ion beam processing equipment (Versa 3D Dual Beam) manufactured by FEI Company Japan. Results are shown in FIG. 7. Voids, peeling and the like are not confirmed between the substrate and all plated layers, and excellent adhesion is indicated. Furthermore, since the silver strike-plated layer was thin, the layer was not able to be clearly observed.

(3) Element Assay

Figure 8:
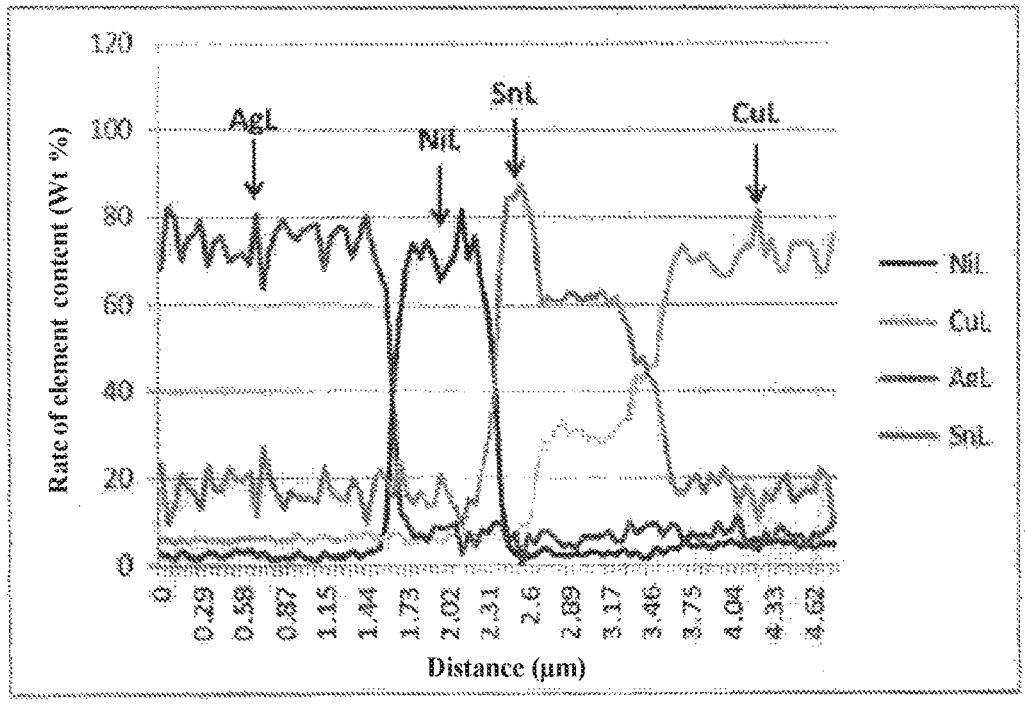
FIG. 8 shows a result of element assay (line analysis) of a specimen in an example of the present invention.

Element assay (linear analysis) of the cross-section observation samples was conducted using a field emission scanning electron microscopy (JSM-7001F) manufactured by JEOL Ltd. under conditions of 20 kV of accelerating voltage and 15.0 mm of WD. Results of linear analysis from the silver-plated layer on the outermost surface to a substrate (copper alloy substrate) are shown in FIG. 8. Furthermore, in the horizontal axis of FIG. 8, '0' indicates the outermost surface within the silver-plated layer. Formation of an alloy layer is confirmed between the substrate and tin-plated layer. Further, diffusion of each metal element is confirmed between the tin-plated layer and the nickel-plated layer and between the nickel-plated layer and the silver-plated layer, and it is ascertained that excellent metallurgical bonding has been accomplished.

Example 7

Except for the application of gold strike plate processing instead of the silver strike plate processing as preliminary processing for forming a nickel-plated layer, a plated laminate was produced as similar to Example 6, and adhesion was evaluated. Obtained results are shown in Table 2.

For the gold strike plate processing above, a titanium platinum plate was used as an anode material and a reflow tin-plated material after the washing treatment above was used as a cathode material in a gold strike plating liquid containing 2 g/L of gold potassium cyanide, 100 g/L of potassium citrate, 5 g/L of chelating agent and 2 g/L of cobalt sulfate, and processing conditions were 40° C. for the bath temperature, 1 A/dm$^2$ for the current density and 10 seconds for the processing time.

Example 8

Except for the application of palladium strike plate processing instead of the silver strike plate processing as preliminary processing for forming a nickel-plated layer, a plated laminate was produced as similar to Example 6, and adhesion was evaluated. Obtained results are shown in Table 2.

For the palladium strike plate processing above, a titanium platinum plate was used as an anode material and a reflow tin-plated material after the washing treatment above was used as a cathode material in a palladium strike plating bath containing 3 g/L of dichloro diammine palladium and 100 g/L of potassium phosphate, and, and processing conditions were 40° C. for the bath temperature, 1 A/dm$^2$ for the current density and 10 seconds for the processing time.

Example 9

Except for the application of nickel strike plate processing instead of the silver strike plate processing as preliminary processing for forming a nickel-plated layer, a plated laminate was produced as similar to Example 6, and adhesion was evaluated. Obtained results are shown in Table 2.

For the nickel strike plate processing above, a nickel plate was used as an anode material and a reflow tin-plated material after the washing treatment above was used as a cathode material in a nickel strike plating liquid containing 100 g/L of nickel chloride and 50 ml/L of hydrochloric acid was used, and, and processing conditions were 20° C. for the bath temperature, 2 A/dm$^2$ for the current density and 10 seconds for the processing time.

Example 10

Except for the application of copper strike plate processing instead of the silver strike plate processing as preliminary processing for forming a nickel-plated layer, a plated laminate was produced as similar to Example 6, and adhesion was evaluated. Obtained results are shown in Table 2.

For the copper strike plate processing above, using a copper strike plating bath containing 10 g/L of copper cyanide, 30 g/L of potassium cyanide and 15 g/L of potassium carbonate, the copper strike plate processing was applied with a titanium platinum plate as an anode material and with a reflow tin-plated material after the washing treatment above as a cathode material, for 10 seconds under processing conditions of room temperature for the bath temperature and 2 A/dm$^2$ for the current density.

Comparative Example 1

Except for not applying the silver strike plate processing, a plated laminate having a silver-plated layer with 1 μm of thickness was produced as similar to Example 2, and various evaluations were conducted. Obtained results are shown in Table 1.

Comparative Example 2

Except for not applying the nickel plate processing, a plated laminate having a silver-plated layer with 1 μm of thickness was produced as similar to Example 1, and various evaluations were conducted. Obtained results are shown in Table 1.

Comparative Example 3

Except for setting a time for the nickel plate processing at 2 seconds and formation of a nickel plated layer with 0.01 μm of thickness, a plated laminate was produced as similar to Example 1, and various evaluations were conducted. Obtained results are shown in Table 1.

Comparative Example 4

Except for not applying the silver strike plate processing as a preliminary processing of the nickel plate processing, a plated laminate was produced as similar to Example 6, and adhesion evaluation as similar to that in Example 6 was conducted. Obtained results are shown in Table 2.

TABLE 1

| | Thickness of nickel-plated layer (μm) | Thickness of silver-plated layer (μm) | Whether or not silver strike plate processing was applied | Results of adhesion evaluation | $Ag_3Sn$ peak |
|---|---|---|---|---|---|
| Example 1 | 0.05 | 1 | Applied | ○ | ○ |
| Example 2 | 0.1 | 1 | Applied | ○ | ○ |
| Example 3 | 0.1 | 5 | Applied | ○ | ○ |
| Example 4 | 0.1 | 10 | Applied | ○ | ○ |
| Example 5 | 10 | 1 | Applied | ○ | ○ |
| Comparative Example 1 | 0.1 | 1 | Not applied | X | ○ |
| Comparative Example 2 | — | 1 | Applied | ○ | X |
| Comparative Example 3 | 0.01 | 1 | Applied | ○ | X |

According to the results shown in Table 1, regarding the examples of the present invention, regardless of thickness of the nickel-plated layer and the silver-plated layer, each interlayer of each plated layer (tin-plated layer/nickel-plated layer, and nickel-plated layer/silver-plated layer) is excellently bonded. In the meantime, when the silver strike plating is not applied, it is confirmed that the silver-plated layer is peeled off according to the adhesion evaluation, and the silver-plated layer and the nickel-plated layer are not excellently bonded (Comparative Example 1).

Further, regarding the examples of the present invention, an intermetallic compound ($Ag_3Sn$) phase is not formed. In the meantime, when a nickel-plated layer does not exist (Comparative Example 2) and is thin (Comparative Example 3), an intermetallic compound ($Ag_3Sn$) phase is formed, and embrittlement of the tin-plated layer and the silver-plated layer are progressed.

TABLE 2

| | Preliminary processing of nickel-plating processing (strike plate processing) | Thickness of nickel-plated layer (μm) | Thickness of silver-plated layer (μm) | Results of cross-cut test |
|---|---|---|---|---|
| Example 6 | Applied | 1 | 5 | ○ |
| Example 7 | Applied | 1 | 5 | ○ |
| Example 8 | Applied | 1 | 5 | ○ |
| Example 9 | Applied | 1 | 5 | ○ |
| Example 10 | Applied | 1 | 5 | ○ |
| Comparative Example 4 | Not applied | 1 | 5 | X |

Excellent results of the cross-cut test were obtained from the plated laminates obtained in Example 6 to Example 9 where various types of strike plate processing were applied as the preliminary processing of the nickel-plating processing, and it has become ascertained that there is no problem between the substrate and all plated layers. In the meantime, with the plated laminates obtained in Comparative Example 4 where no strike plate processing was applied as the preliminary processing of the nickel-plating processing, peeling was confirmed between the tin-plated layer and the nickel-plated layer in the cross-cut test.

DESCRIPTION OF SYMBOLS

1 . . . plated laminate
2 . . . metal substrate
4 . . . tin-plated layer
6 . . . nickel-plated layer
8 . . . silver strike-plated layer
10 . . . silver-plated layer
12 . . . connecting terminal
14 . . . contact part
16 . . . connection part

What is claimed is:

1. A method for manufacturing a plated laminate where a silver-plated layer is formed on a tin-plated layer formed on a surface of a metal substrate, comprising:

a first step of applying nickel-electroplating processing in any region on the surface of the tin-plated layer to form a nickel-plated layer;

a second step of applying silver strike plate processing in any region on the surface of the nickel-plated layer; and a third step of applying silver electroplate processing to at least a portion on the surface of the nickel plated layer after the silver strike processing has been applied, further comprising before the first step, a pre-processing step comprising applying to any region on the surface of the tin-plated layer where the nickel-plated layer will be formed at least one type of strike plating selected from the group consisting of silver strike plating, gold strike plating, palladium strike plating, nickel strike plating, and copper strike plating.

2. The method for manufacturing a plated laminate according to claim 1, wherein the thickness of the silver-plated layer is 0.1 μm to 50 μm, and the Vickers hardness of the silver-plated layer is 10 HV to 250 HV.

3. The method for manufacturing a plated laminate according to claim 1, wherein the thickness of the nickel-plated layer is 0.05 μm to 10 μm.

* * * * *